US006814851B2

(12) United States Patent
Sasaki et al.

(10) Patent No.: US 6,814,851 B2
(45) Date of Patent: Nov. 9, 2004

(54) METHOD AND APPARATUS FOR AN ANODIC TREATMENT

(75) Inventors: Masato Sasaki, Kanagawa (JP); Masazumi Ishikawa, Kanagawa (JP); Sachiko Sugita, Gunma (JP)

(73) Assignee: Unisia Jecs Corporation, Atsugi (JP)

( * ) Notice: Subject to any disclaimer, the term of this patent is extended or adjusted under 35 U.S.C. 154(b) by 53 days.

(21) Appl. No.: 10/263,786

(22) Filed: Oct. 4, 2002

(65) Prior Publication Data

US 2003/0085134 A1 May 8, 2003

(30) Foreign Application Priority Data

Nov. 5, 2001 (JP) ..... 2001-339889

(51) Int. Cl.[7] ..... C25D 11/04

(52) U.S. Cl. ..... 205/324; 205/316; 205/133; 205/333; 204/224 R; 204/275.1

(58) Field of Search ..... 205/316, 324, 205/133, 333; 204/224 R, 275.1

(56) References Cited

U.S. PATENT DOCUMENTS 6,322,689 B1 11/2001 Omasa
2004/0016645 A1 * 1/2004 Rasmussen ..... 205/106

FOREIGN PATENT DOCUMENTS

JP 9-217200 8/1997

* cited by examiner

*Primary Examiner*—Wesley A. Nicolas
(74) *Attorney, Agent, or Firm*—Foley & Lardner LLP

(57) ABSTRACT

A method and apparatus for anodizing a component. The component is placed in a container having a supply port, a drain port and a supply passage. The supply passage faced on a surface of the component to be anodized. A reaction medium is supplied from the supply port to the drain port. An electric current is supplied from an electrode provided on the drain port side of the surface. The apparatus prevents any hydrogen gas created by the electrode from recirculating to the surface of the component.

29 Claims, 6 Drawing Sheets

METHOD AND APPARATUS FOR AN ANODIC TREATMENT

BACKGROUND OF THE INVENTION

1. Field of the Invention

This invention relates to a method and an apparatus for an anodic treatment on metallic parts. More particularly, the present invention relates to a method and an apparatus for anodizing a surface of the metallic parts.

2. Description of the Related Art

It is known that many metallic components or parts need a final treatment.

Such a surface treatment increases functionality and the lifetime of the part by improving any of various characteristics, such as protection, wear resistance, hardness, electrical conductivity, lubricity or cosmetic value.

One example of such a metallic component is the head of aluminum pistons used in combustion engines. (As used herein an aluminum component is a component at least partially made of aluminum, including aluminum alloys.) The piston head used in the internal combustion engine is placed close to a combustion zone. More particularly this portion of the piston is in contact with hot gases, and therefore, is subject to high-thermal stresses that may cause deformations or changes in the metallurgical structure. This negatively affects the functioning of the piston head.

To reduce this negative effect, a surface of the piston is treated by an anodic treatment in order to develop an anodic oxide coating that protects the metal from the high-thermal stresses. One such apparatus that performs the anodic treatment is disclosed in, for example, Japan Patent Publication (koukai) No. 9-217200 (incorporated herein by reference). According to that publication, as shown in FIG. 7, the apparatus includes a jacket 101, a lid member 102, a mask socket 103, an O-ring 105, an electrolyte bath 106, a nozzle system 107, a cathode 108, and an anode 109. The jacket 101 forms a part of a circulation circuit of electrolyte (reaction medium), and has a substantially cup shape. The jacket 101 has an opening, which is closed by the lid member 102, at its upper end. The electrolyte bath 106 is provided in the jacket 101. A hole in which the mask socket 103 is fitted is formed at the center of the lid member 102. The mask socket 103 is substantially cylindrical in shape, and is provided at its lower opening portion with an inwardly projected flange portion. A piston 104 is placed in the mask socket 103 in an inverted position. Namely, the piston 104 is inserted into the mask socket 103 by the piston head.

The O-ring 105 is placed on flange portion of the mask socket 103. The O-ring 105 contacts a surface of the piston head when the piston 104 is placed in the mask socket 103. This seals a portion of the piston that is not to be anodized. The nozzle system 107, through which the electrolyte is directed to the piston 104, is placed in the electrolyte bath 106. The cathode 108 is provided at an upper portion of the electrolyte bath 106. The anode 109 contacts the piston 104. The apparatus performs the anodic treatment on an end face of the component (piston).

In the anodizing process, the treatment target, i.e., the piston 104, functions as an anode. Hydroxide ions generated by the electrical discharge generate oxygen which is used to oxidize the surface of the piston 104, i.e., the anode, to form the oxide film on the surface of the piston 104. At the same time, however, the interaction of the electrolyte and the cathode 108 generates hydrogen gas, which flows along the current of the electrolyte. This results in hydrogen adhering to the surface of the piston 104. The hydrogen adhered to the piston 104 causes a serious problem that the hydrogen inhibits a stable anodizing reaction of the piston 104.

As mentioned above this problem is especially problematic with this apparatus. Because a flow from the electrolyte bath to the surface of the piston 104 is not separated from the cathode 108, the hydrogen gas generated from the cathode 108 rides the flow to the surface of the piston 104. Namely, the hydrogen adhered to the surface of the piston 104 interferes with the anodizing reaction. As a result, a stable anodic oxide coating is not formed on the surface of the piston 104. The cathode 108 is positioned relative to the piston 104 in order to reduce the loss by the electrical resistance, or improve the productivity. In such case, the closer the interval between the cathode 108 and the piston 104, the higher the tendency that hydrogen adheres to the piston 104.

SUMMARY OF THE INVENTION

According to an embodiment of the present invention an improved method for anodizing a component is provided. The method includes providing a container comprising a supply port, a drain port, and a supply passage connecting the supply port and the drain port, at least a portion of the supply passage including a reaction chamber in fluid connection with a surface of the component to be anodized, and supplying an electric current from an electrode positioned fluidly downstream of the component surface. The method further includes supplying a reaction medium from the supply port to the drain port through the supply passage. The reaction medium that is fluidly downstream of the component surface flows toward the drain port without recirculating to the reaction chamber.

In another embodiment, the method may further include at least one seal member separating a first surface of the component to be anodized from a second surface of the component no to be anodized.

According to another aspect of the present invention, an apparatus for anodizing a component is provided. The apparatus includes a container comprising a portion defining a receiving hole for receiving the component into the container, a supply port in the container for supplying a reaction medium, a drain port in the container for draining the reaction medium, a supply passage connecting the supply port and the drain port, at least a portion of the supply passage including a reaction chamber in fluid connection with a surface of the component to be anodized, and an electrode for supplying an electric current, the electrode being positioned fluidly downstream of the component surface. The supply passage causes the reaction medium that is fluidly downstream of the component surface to flow toward the drain port without recirculating to the reaction chamber.

The apparatus may further include a first seal member for separating a first surface of the component to be anodized from a second surface of the component not to be anodized. The apparatus may alternatively include two seal members, wherein the first seal member and a second seal member separate an annular surface portion of the component to be anodized from a remaining surface portion of the component not to be anodized. Preferably, the supply port and the drain port are formed on opposite sides of the container in a radial direction.

It is to be understood that both the foregoing general description and the following detailed description are exemplary and explanatory only, and are not restrictive of the invention as claimed.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

DETAILED DESCRIPTION

Figure 1:
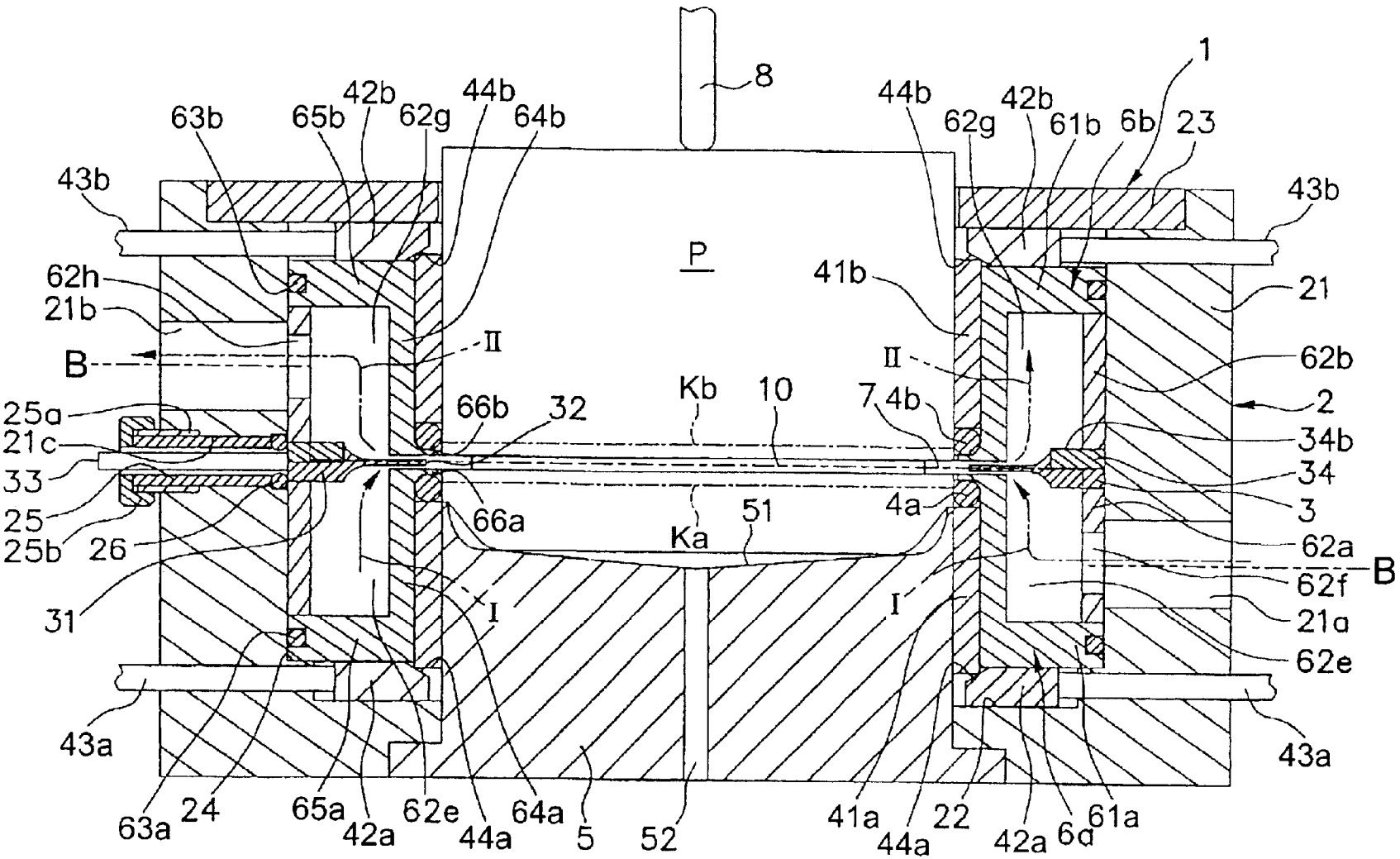
FIG. 1 is a sectional view of an anodizing apparatus according to a first embodiment of the present invention.

An apparatus for an anodic treatment according to preferred embodiments will now be described with a reference to the drawings. FIGS. 1–4 show a first embodiment of the present invention. In this first embodiment, the apparatus provides an anodic oxide coating on a surface of a top-ring groove of a piston P. As shown in FIG. 1, the apparatus comprises a container 1 having an outer cylindrical member 2, a passage plate 3, a first seal member (O-ring) 4*a*, a second seal member (O-ring) 4*b*, and a push mechanism. The first and second seal members 4*a*, 4*b* are made of fluorine rubber. The push mechanism comprises a first sleeve 41*a*, a second sleeve 41*b*, a first push ring 42*a*, a second push ring 42*b*, and a plural push rods 43*a*, 43*b*.

The container 1 may be cylindrical in shape, and includes a receiving hole (not numbered) for receiving the piston P with an inverted (upside-down) state, a bottom member 5, and lower and upper wall members 6*a*, 6*b*.

The outer cylindrical member 2 includes a cylindrical wall section 21 and an inwardly projected flange section 22. An inlet 21*a* and an outlet 21*b* are formed in the outer cylindrical member 2 on opposite sides of the container 1 in radial direction. An upper end of the cylindrical wall section 21 is closed by an annular cover member 23. The annular cover member 23 and the flange section 22 project inward, respectively, from the upper and a lower end of the outer cylindrical member 2, thus defining an annular groove that receives the lower and upper wall members 6*a*, 6*b*.

The bottom member 5 forms a bottom portion of the container 1, and is substantially cylindrical in shape having an outer diameter approximately equal to an outer diameter of the piston P. The bottom member 5 is arranged in the outer cylindrical member 2, with its lower periphery being fitted in the flange section 22, to form the container 1.

While various of the components are shown as cylindrical, this shape is merely preferred. The present invention includes within its scope a container, component and other mentioned elements having various shapes suitable for use with the apparatus and method described herein.

The lower wall member 6*a* comprises an exterior member 61*a* and an interior member 62*a*, and, similarly, the upper wall member 6*b* comprises an exterior member 61*b* and an interior member 62*b*. The exterior member 61*a* has a cylindrical section 64*a*, an outward flange section 65*a* and an inward flange section 66*a*. Similarly, the exterior member 61*b* has a cylindrical section 64*b*, an outward flange section 65*b* and an inward flange section 66*b*. More particularly, in an assembled state as shown in FIG. 1, the outward flange section 65*a* is formed at a lower portion of the cylindrical section 64*a* of the lower wall member 6*a*, while the inward flange section 66*a* is provided at an upper portion of the cylindrical section 64*a*. The inward flange section 66*a* of the exterior member 61*a* positions and supports the first seal member 4*a*. The exterior member 61*a* is arranged in the annular groove of the outer cylindrical member 2, a lower face of the outward flange section 65*a* abuts a stepped portion 24 formed on the flange section 22.

The interior member 62*a*, in the assembled state, is cylindrical in shape, the outer diameter of which is the same as the outer diameter of the outward flange section 65*a*. The interior member 62*a* is disposed between the exterior member 61*a* and the outer cylindrical member 2. There is formed a hole 62*f* in the interior member 62*a* that communicates the inlet 21*a*. An inner space 62*e* is defined between the exterior member 61*a* and the interior member 62*a*. The inner space 62*e* is formed in the shape of a continuous annular ring. Thereby, the inner space 62*e* and the inlet 21*a* communicate with each other.

Similar to the lower wall member 6*a*, the upper wall member 6*b* also includes the exterior member 61*b* and the interior member 62*b*, both of which are shaped approximately like inverted forms of the exterior and interior members 61*a*, 62*a*, respectively. Therefore, an inner space 62*g* is defined between the exterior member 61*b* and the interior member 62*b*, is formed in the shape of a continuous annular ring. There is formed a hole 62*h* in the interior member 62*b* that communicates the outlet 21*b*. Thereby, the inner space 62*g* and the outlet 21*b* communicate with each other. The upper wall member 6*b* including the exterior member 61*b* and the interior member 62*b* is arranged above the lower wall member 6*a* including the exterior member 61*a* and the interior member 62*a* so that the passage plate 3 is pinched between the interior members 62*a* and 62*b*. This forms a reaction chamber 7 between the inward flange sections 66*a* and 66*b* of the exterior members 61*a*, 61*b*. Axial dimensions of the passage plate 3, the exterior members 61*a*, 61*b* and the interior members 62*a*, 62*b* are determined so as to form the reaction chamber 7.

In addition, first and second sealing rings 63*a*, 63*b* seal contact surfaces between the outer cylindrical member 2 and the exterior members 61*a*, 61*b* respectively.

Figure 2:
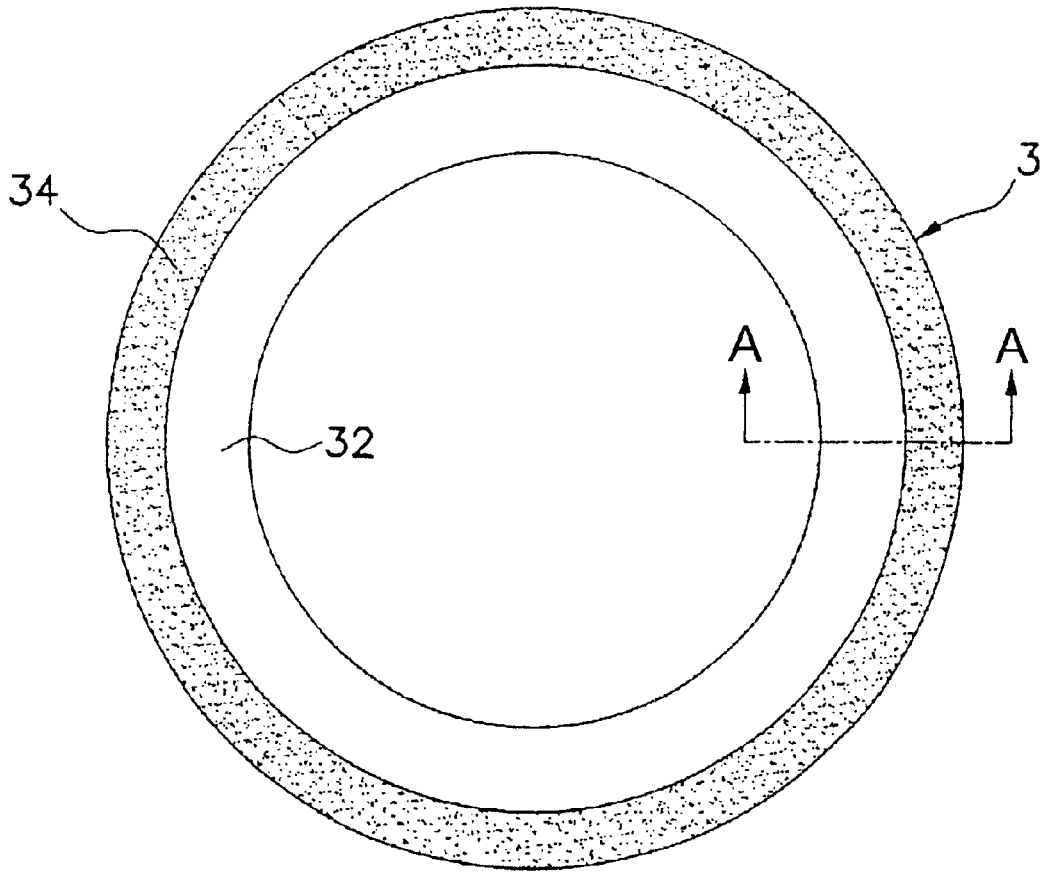
FIG. 2 is a front view of a passage plate according to the first embodiment of the present invention.
Figure 3:
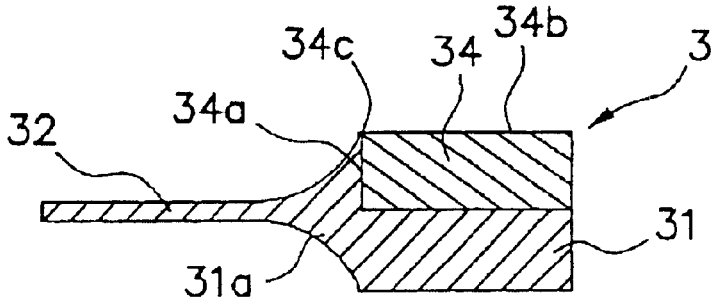
FIG. 3 is an enlarged sectional view of the passage plate taken on line A—A of FIG. 2.
Figure 4:
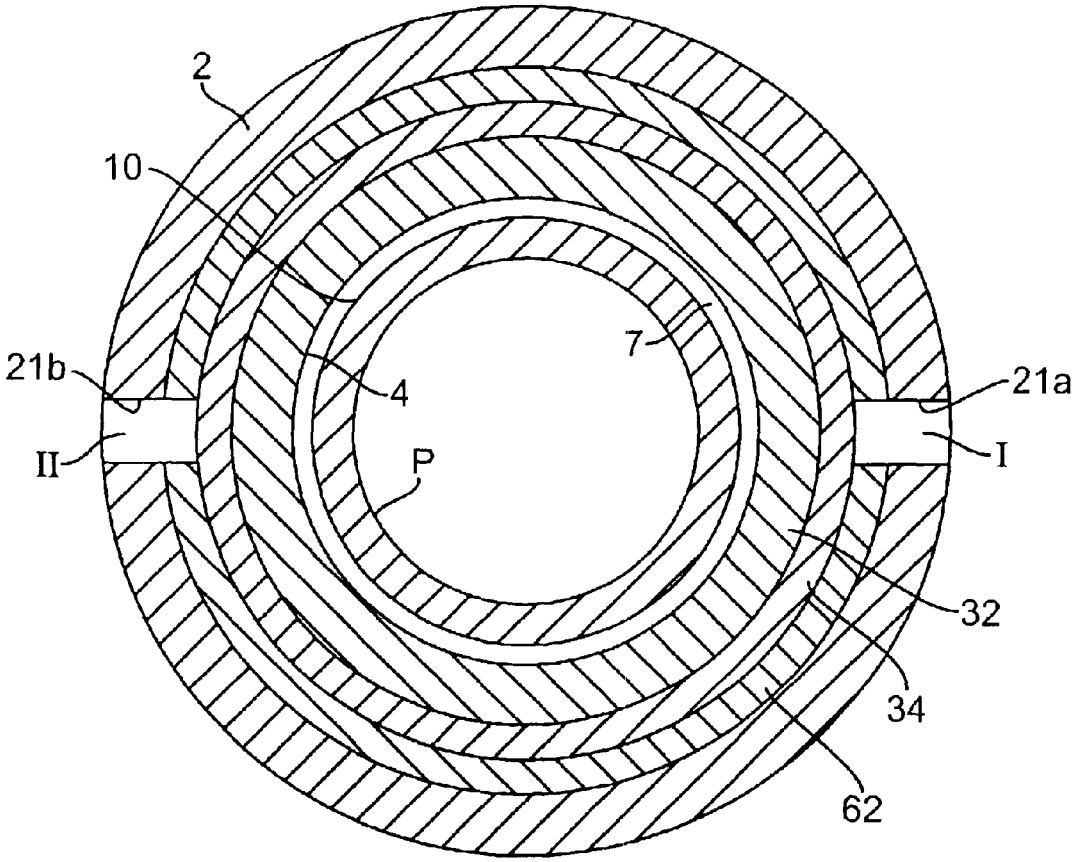
FIG. 4 is a sectional view taken on line B—B of FIG. 1.

The passage plate 3 has a main section 31 and an inner section 32 projecting radially inwardly from the main section 31 (shown in FIGS. 2 and 3). The inner section 32 is formed integrally with the main section 31 having a thickness thinner than a thickness of the reaction chamber 7. An oblique surface 31 a is formed between the main section 31 and the inner section 32, in order to reinforce the joint therebetween. Also, the passage plate 3 is made of polychloroethene. As shown in FIG. 1, the passage plate 3 is arranged so that a tip of the inner section 32 is placed at approximately a middle portion of the reaction chamber 7 along a radial direction of the reaction chamber 7.

A cathode plate 34 which is formed in the shape of a continuous annular ring is recessed concentrically on the passage plate 3. The cathode plate 34 is made of titanium, and acts as an electrode. The maximum thickness of the passage plate 3 is about twice the thickness of the cathode plate 34 in up and down directions thereof. An inner radius surface 34*a* of the cathode plate 34 and a corner 34*c* which is defined between the inner radius surface 34*a* and a upper surface 34*b* of the cathode plate 34 are covered by the oblique surface 31*a*. Thereby, the inner radius surface 34*a* and the corner 34*c* are hidden by the oblique surface 31*a* in a radial view from the inner section 32. The passage plate 3, in the assembled state, separates the inner spaces 62*e* and 62*g*. The cathode plate 34 is exposed to the inner space 62*g*. In addition, the inner section 32 of the passage plate 3 is disposed between the inward flange sections 66*a* and 66*b*. There are clearances between the inner section 32 and the inward flange sections 66*a*, 66*b* vertically respectively. Thereby, the inner space 62*e* and the inner space 62*g* communicate each other through the reaction chamber 7 and all around the reaction chamber 7.

As mentioned above, the cylindrical wall section 21 of the outer cylindrical member 2 has the inlet 21*a*. The inlet 21*a* communicates with the inner space 62*e* through the hole 62*f* of the interior member 62*a*. On the other hand, the outlet 21*b* communicates with the inner space 62*g* through the hole 62*h* of the interior member 62*b*. Namely, as shown in FIG. 1, an inlet passage I, which is in communication with the inlet 21*a* and the reaction chamber 7, is defined by the inner space 62*e*, the hole 62*f* and the inlet 21*a*. Similarly, an outlet passage II, which is in communication with the outlet 21*b* and the reaction chamber 7, is defined by the inner space 62*g*, the hole 62*h* and the outlet 21*b*.

The reaction medium, which is an aqueous containing sulfuric acid as a dissolved matter, is introduced from the inlet 21*a*, and then flows through the hole 62*f* to the inner space 62*e*. The reaction medium flows in the clearance between the inner section 32 and the inward flange section 66*a*. Therefore, the reaction medium comes into contact with the surface of the top-ring groove of the piston P in the reaction chamber 7. The reaction medium, flowing across the piston surface, then flows in the clearance between the inner section 32 and the inward flange section 66*b*, the inner space 62*g*, and the hole 62*h*. The reaction medium then drains from the outlet 21*b*. The cathode plate 34 is immersed in the reaction medium at all times, so the reaction medium entirely conducts electricity with the cathode plate 34.

The first sleeve 41*a* is disposed between the exterior member 61*a* and the bottom member 5, with a slidable contact in an axial direction of the outer cylindrical member 2, to push the first seal member 4*a*. The first push ring 42*a* is arranged between the flange section 22 and the outward flange section 65*a* of the exterior member 61*a* and slides in a radial direction of the outer cylindrical member 2. The first push ring 42*a* has a tapered surface 44*a* that contacts a lower end portion of the first sleeve 41*a*. Also, the first push ring 42*a* is arranged in a space defined between an upper surface of the flange section 22 and the lower surface of the outward flange section 65*a* of the lower wall member 6*a*. The push rods 43*a* are slidably received in holes radially formed in the cylindrical wall section 21, and they push the push ring 42*a* in an inward direction thereof.

Similarly, the second sleeve 41*b* is arranged on an inner side of the exterior member 61*b* included in the upper wall member 6*b* with a slidable contact in its axial direction, i.e., vertically. The second sleeve 41*b* pushes the second seal member 4*b* downwardly. Also, the second push ring 42*b* is provided between the annular cover member 23 and the outward flange section 65*b* of the exterior member 61*b* and slides in the radial direction of the outer cylindrical member 2. The second push ring 42*b* has a tapered surface 44*b* that contacts an upper end of the second sleeve 41*b*, and is disposed in order to be pushed toward a center thereof by a plural push rods 43*b*.

The dimensions of above described elements are preferably determined so that a position of a top ring groove 10 of the piston P becomes identical to that of the reaction chamber 7 in the axial direction of the piston P. The first and second seal members 4*a*, 4*b* are located nearby upper and lower edges of the top ring groove 10, respectively, when the receiving hole of the container 1 receives the piston P in the inverted state with a bottom surface of the piston P (piston head) abutting a concave portion 51 formed on an upper surface of the bottom member 5. Thereby, lower boundary line Ka and upper boundary line Kb, which define an area to be anodized, are defined.

The outer cylindrical member 2 has a penetration hole 21*c*, which receives a push tube 25, at a portion facing an outer cylindrical surface of the cathode plate 34. A sealing ring 26 is provided in the penetration hole 21*c*. The push tube 25 presses the sealing ring 26 to prevent a leakage of the reaction medium into the penetration hole 21*c*. A conductive rod 33 is inserted into the push tube 25 having an end portion thereof abutted the outer cylindrical surface of the cathode plate 34 that acts as an electrode. In this manner, the conductive rod 33 abuts the cathode plate 34 at a portion not exposed in the reaction medium. The push tube 25 is fixed in the penetration hole 21*c*, with an engaged state toward the passage plate 3, by a screw tube 25*a* and a screw 25*b*. That is, the screw tube 25*a* is secured to the outer cylindrical member 2, and the screw 25*b*, in turn, is fixed to the screw tube 25*a*. When the conductive rod 33 is energized, the cathode plate 34, which abuts on the conductive rod 33 and is made of titanium, is also energized. On the other hand, as mentioned above, the passage plate 3 is made of polychloroethene. Therefore, even though the passage plate 3 abuts the cathode plate 34, the passage plate 3 is not energized.

A drain hole 52 is provided at a center of the concave portion 51 for draining the reaction medium that may leak from the reaction chamber 7 when the piston P is removed from the receiving hole. Also, another electrode (anode rod 8) is provided so as to abut the piston P when the piston is received in the receiving hole.

As described previously, according to the first embodiment of the present invention, the piston P is received in the receiving hole, and the first and second push rings 42*a*, 42*b* are urged inwardly by the plural push rods 43*a*, 43*b*, the annular tapered surfaces 44*a*, 44*b* of the first and second push rings 42*a*, 42*b* abut the lower end of the first sleeve 41*a* and the upper end of the second sleeve 41*b*, respectively. Thus, the first and second sleeves 41*a*, 41*b* move in those axial directions, and compress the first and second seal members 4*a*, 4*b*, respectively. By virtue of the compression by the axial movement of the sleeves 41*a*, 41*b*, the seal members 4*a*, 4*b* shorten their inner diameters in the axial direction of the piston P. Thereby, the seal members 4*a*, 4*b* abut the boundary lines Ka, Kb providing a sealing function. The reaction chamber 7 that holds the reaction medium is formed generally by an annular surface of the piston P (a portion being anodized) and the first and second seal members 4*a*, 4*b*. The annular cylindrical surface of the piston P includes a surface of the top ring groove 10.

When a pump (not shown) is started, the reaction medium is supplied to the reaction chamber 7 through the inlet 21*a* and the inlet passage I, i.e., the hole 62*f* and the inner space 62*e*. Then, the reaction medium is directed to the surface of the top ring groove 10 passing through a lower side of the inner section 32 of the passage plate 3. Through an upper side of the inner section 32 of the passage plate 3, the reaction medium leaves the reaction chamber 7, and then, flows to the outlet passage II, i.e., the inner space 62*g*, the hole 62*h* and the outlet 21*b*.

At this time, direct current is supplied to the cathode plate 34 and the anode rod 8 in order to carry out an anodizing reaction. The direct current passes along the surface of the top ring groove 10, the reaction medium in the reaction chamber 7, the reaction medium in the inner space 62*g*, and the cathode plate 34. Thereby, the anodic treatment on a limited portion of the piston P including the surface of the top ring 10 can be annularly provided. When passing the direct current between the anode rod and the cathode plate 34, hydrogen ion, which being contained in the reaction medium contacting with the cathode plate 34, produces hydrogen gas by obtaining electrons from the cathode plate 34. The reaction medium, which drained from the reaction chamber 7, contacts with the cathode plate 34. In addition, the cathode plate 34 is disposed about midway of the outlet passage II. The reaction medium flows forcibly to remove hydrogen gas from the cathode plate 34. And then, the hydrogen gas is drained out from the outlet 21*b* with the reaction medium immediately. No recirculation of the reaction medium to the reaction chamber 7 occurs.

As detailed above, because the hydrogen gas is drained with the reaction medium, the hydrogen gas does not adhere the anodized surface, which faces the reaction chamber 7. Consequently, a uniform treatment of the anodization is performed in the circumferential direction of the piston P.

Furthermore, the outlet 21*b* is provided at a higher position than that of the outlet passage II, and thus air mixed in the reaction medium is efficiently exhausted when the reaction medium leaves the container through the outlet 21*b*. Therefore, an uneven reaction of the anodic treatment may be caused by the air mixed in the reaction medium.

Also, after the piston P is placed in the receiving hole, the seal members 4*a*, 4*b* abut the cylindrical surface of the piston P providing the boundary lines Ka, Kb that determine the annular cylindrical surface, by axial movements of the first and second sleeves 41*a*, 41*b* caused by inward movements of the plural push rods 43*a*, 43*b*. Thus, the anodic treatment at the middle portion on the cylindrical surface of the piston P is provided without requiring a masking procedure. This increases working efficiency and a processing capability.

Further, according to the first embodiment, the area that is exposed to the reaction medium is made narrower by the seal members 4*a*, 4*b*, so that less electric power is necessary, as compared to the conventional apparatus for anodizing the piston top surface. Thereby, a heat generation is reduced. Also, since volume of the reaction chamber 7 is small and a flow of the reaction medium is formed in the horizontal direction of the passage plate 3, a flow velocity of the reaction medium is obtained with a smooth flow. This provides an improvement in a cooling efficiency of the reaction medium. This permits use of a less costly cooling machine for the reaction medium. Also, a volume of the reaction medium necessary for the anodic treatment of the piston is reduced.

In addition, the inner section 32 of the passage plate 3 is disposed between the inward flange sections 66*a* and 66*b*, which divides the reaction chamber 7 into two sections vertically. This defines the end of the inlet passage I and the starting point of the outlet passage II. The end of the inlet passage I and the starting point of the outlet passage II are formed continuously. Thereby, the reaction medium smoothly flows in the reaction chamber.

Furthermore, the reaction medium flows through the reaction chamber 7, which is dimensioned in accordance with an area of the annular cylindrical surface with a minimal volume. The apparatus can thereby be reduced in size. Also, because of the area of the annular cylindrical surface is dimensioned narrowly, the amount of harmful gases, such as hydrocarbon, that might adhere to an anodized surface is reduced.

Moreover, the conductive rod 33 provided for carrying an electricity to the cathode plate 34 is disposed outside the reaction chamber 7 so as not to be exposed to the reaction medium, thereby preventing a corrosion of a point of the conductive rod 33 and the cathode plate 34 that might be caused by the reaction medium.

Figure 5:
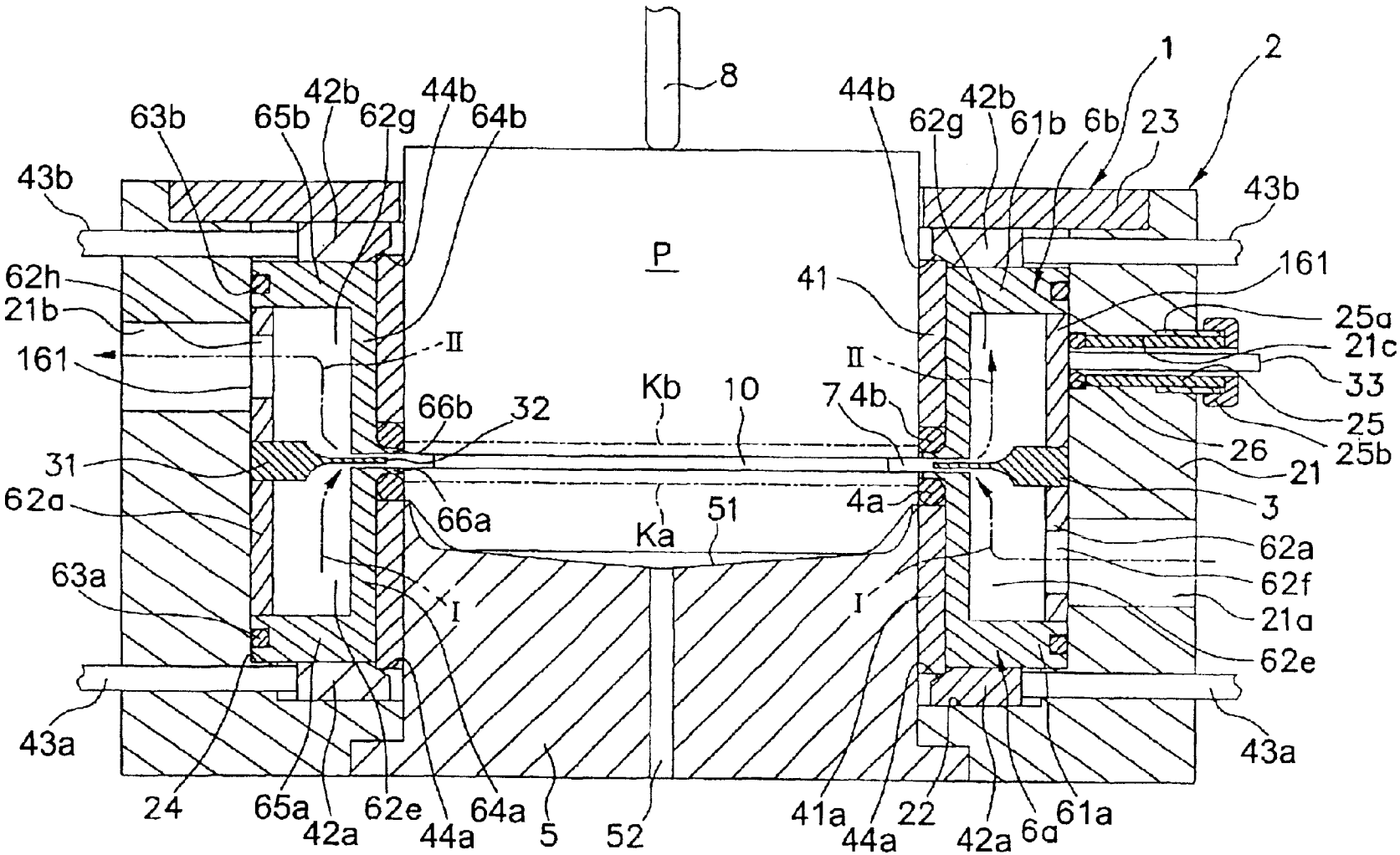
FIG. 5 is a sectional view of an anodizing apparatus according to a second embodiment of the present invention.

Next, an anodizing apparatus according to a second embodiment will be described. In this embodiment, the same or similar references used to denote elements in the anodizing apparatus of the first embodiment will be applied to the corresponding elements used in the second embodiment, and only the significant differences from the first embodiment will be described. FIG. 5 shows a sectional view of the second embodiment of the present invention.

The anodizing apparatus of the second embodiment is similar to the first embodiment shown in FIGS. 1–4, except that it provides an alternative structure for the passage plate 3, cathode plate 34 and the interior member (previously element 62*b*). Namely, a cathode wall member 161 is disposed between the exterior member 61*b* and the outer cylindrical member 2.

The cathode wall member 161 is shaped similar to the interior member 62*b* of the first embodiment. The cathode wall member 161, in the assembled state, is cylindrical in shape, the outer diameter of which is the same as the outer diameter of the outward flange section 65*b*. There is formed the hole 62*h* in the cathode wall member 161 facing the outlet 21*b*. The cathode wall member 161 is made of the same kind of material of the cathode plate 34, which acts as an electrode. Also, the penetration hole 21*c* is disposed in the outer cylindrical member 2, at a portion that faces to an outer cylindrical surface of the cathode wall member 161. Similarly, push tube 25, the sealing ring 26 and the conductive rod 33 are provided in the penetration hole 21*c*. Namely, the conductive rod 33 is inserted into the push tube 25 having an end portion thereof abutted the outer cylindrical surface of the cathode wall member 161.

Thus, according to the second embodiment of the present invention, the cathode wall member 161 functions as the electrode as well as the interior member. Therefore, a part of the outlet passage II is defined within of the cathode wall member 161. After the reaction medium is drained from the reaction chamber 7, the reaction medium is introduced into the inner space 62*g*, through the hole 62*h*, and then, drained through the outlet 21*b*. The reaction medium contacts the cathode wall member 161 in this path. Therefore, the hydrogen gas generated on the surface of the cathode wall member 161 is torn away from the cathode wall member 161 by the forcible flow of the reaction medium. And then, the hydrogen gas is immediately drained out from the outlet 21*b* with the reaction medium.

In the second embodiment, an effect similar to the first embodiment is obtained. In addition, simplicity in the structure of the passage plate 3 is obtained. Also, the electrode (i.e., the cathode wall member 161) covers a sufficient area even if the radial size of outer cylindrical member 2 is reduced.

Figure 6:
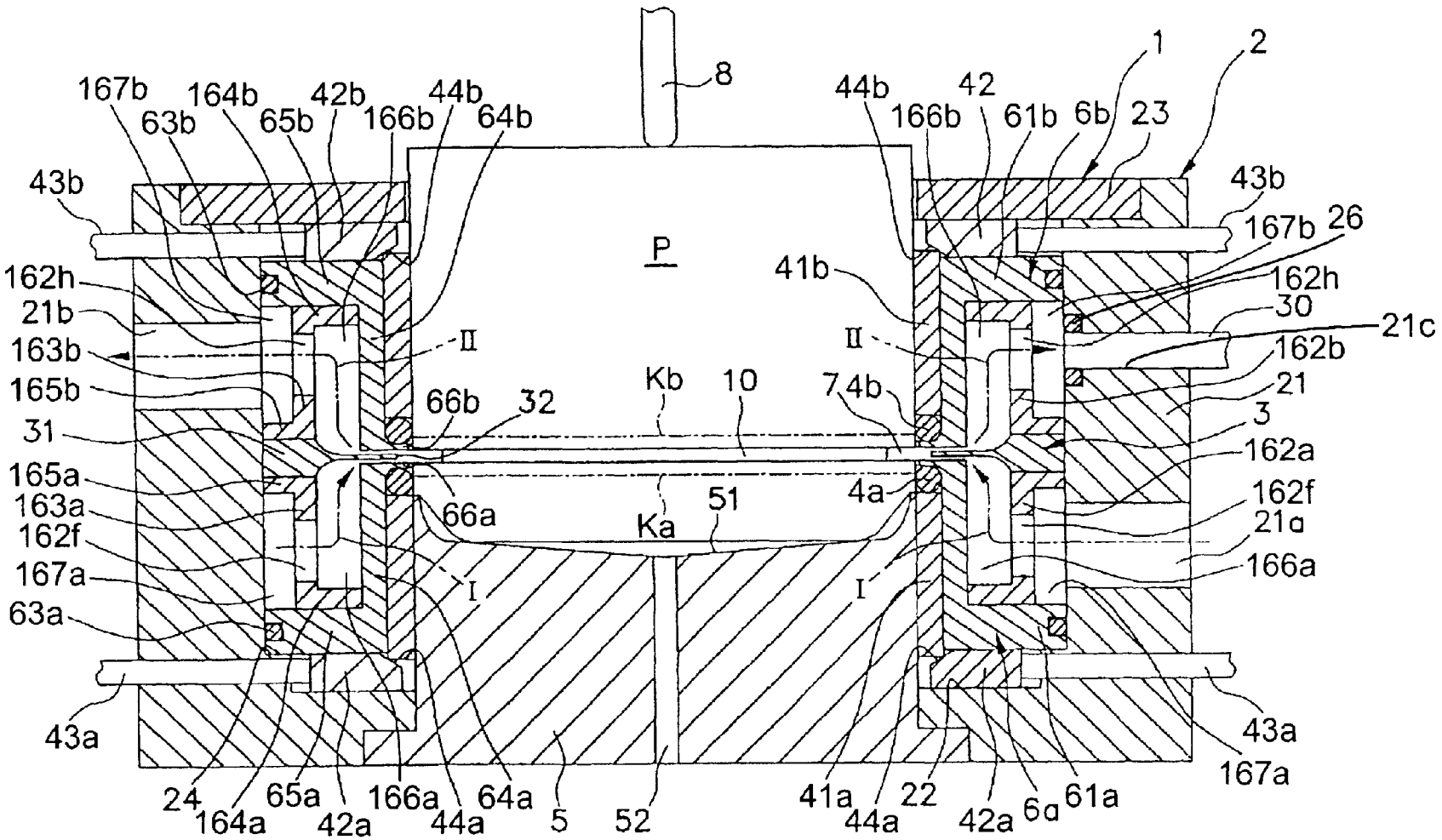
FIG. 6 is a sectional view of an anodizing apparatus according to a third embodiment of the present invention.
Figure 7:
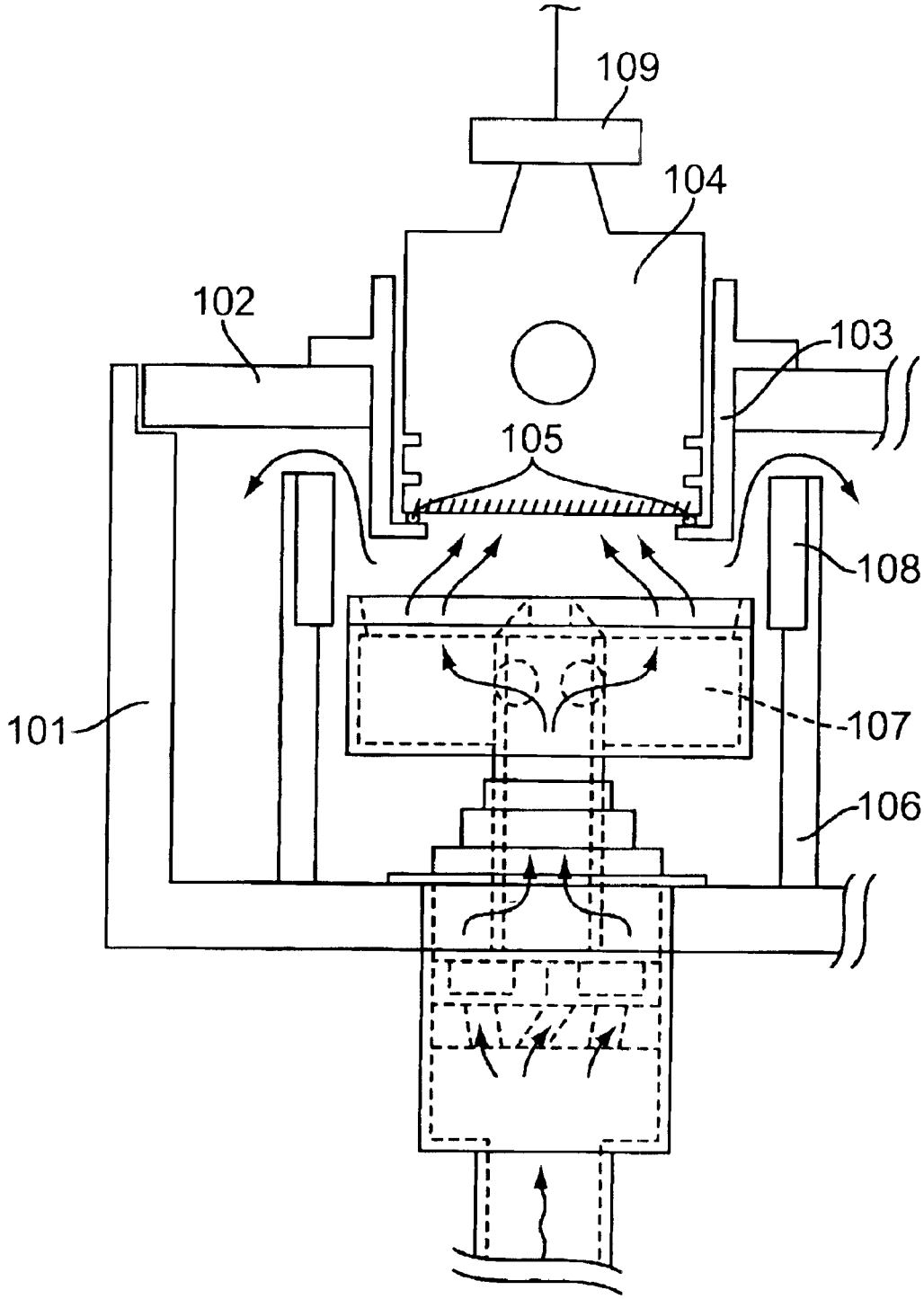
FIG. 7 is a sectional view of an anodizing apparatus according to the prior art.

Next, an anodizing apparatus according to a third embodiment of the present invention is shown in FIG. 6. FIG. 6 is a cross sectional view of the third embodiment. As will be appreciated, this embodiment is similar to the first and second embodiment, except that an interior member 162*a* and an interior member 162*b* replace the interior members 62*a*, 62*b*, and a cathode rod 30 is provided in the penetration hole 21*c*. Namely, the interior member 162*a* includes, in an assembled state as shown in FIG. 6, a cylindrical section 163*a*, an inward flange section 164*a* formed at a lower portion of the cylindrical section 163*a*, and an outward flange section 165*a* formed at an upper portion of the cylindrical section 163*a*. A plurality of holes 162*f* are formed in the cylindrical section 163*a*. Thereby, the previous inner space 62*e* is separated into an inside space 166*a* and an outside space 167*a*. The inside space 166*a* is defined radially between the exterior member 61*a* and the interior member 162*a*, and the outside space 167*a* is defined radially between the interior member 162*a* and the outer cylindrical member 2. And the inside space 166*a* and the outside space 167*a* communicate with each other through the holes 162*f*.

Similar to the interior member 162*a*, an interior member 162*b* also includes a cylindrical section 163*b*, an inward flange section 164*b* and an outward flange section 165*b*, which is shaped approximately as inverted forms of the interior member 162*a*. There are formed a plural holes 162*h* in the cylindrical section 163*b*. Therefore, an inside space 166*b* is defined radially between the exterior member 61*b* and the interior member 162*b*, and the outside space 167*b* is defined radially between the interior member 162*b* and the outer cylindrical member 2. The inside space 166*b* and the outside space 167*b* communicate with each other through the holes 162*h*.

Therefore, the inlet passage I is defined in an order including the inlet 21*a*, the outside space 167*a*, the holes 162*f*, the inside space 166*a*, and the reaction chamber 7. On the other hand, the outlet passage II is defined in an order including the reaction chamber 7, the inside space 166*b*, the holes 162*h*, the outside space 167*b*, and the outlet 21*b*.

The cathode rod 30 is rodlike in this embodiment, which acts as an electrode. The cathode rod 30 is inserted into the outer cylindrical member 2 facing the outside space 167*b*. Specifically, one end surface of the cathode rod 30 is exposed to the reaction medium, with an end surface substantially flush with an inner surface of the outer cylindrical member 2. The sealing ring 26 is provided to prevent a leakage of the reaction medium into the penetration hole 21*c*.

Therefore, the reaction medium flows in an order including the inlet 21*a*, the outside space 167*a*, the holes 162*f*, the inside space 166*a*, and the reaction chamber 7. The reaction medium comes into contact with the surface of the top-ring groove of the piston P in the reaction chamber 7. The reaction medium flowing after the piston surface flows in an order including the reaction chamber 7, the inside space 166*b*, the holes 162*h*, the outside space 167*b*, and the outlet 21*b*. As the cathode rod 30 is immersed into the reaction medium in the outside space 167*b*, the hydrogen gas generated on the surface of the cathode rod 30 is broken away from the cathode rod 30 by the forcible flow of the reaction medium. And then, the hydrogen gas is immediately drained out from the outlet 21*b* with the reaction medium.

Accordingly, in the third embodiment, effects similar to the first and second embodiments are obtained. In addition, this embodiment provides uniform flow of the reaction medium in the reaction chamber 7, obtaining uniformity of the reaction medium contacting the annular cylindrical surface. Thus, according to the third embodiment of the present invention, simplicity in the structure of the electrode (cathode) is obtained by an omitting the push tube 25, screw tube 25*a* and screw 25*b*. Furthermore, a back-flow of the reaction medium including the hydrogen gas is prevented by separating the inner space 62*g* into the inside space 166*b* and the outside space 167*b*.

While the present invention is described on the basis of certain preferred embodiments, it is not limited thereto, but is defined by the appended claims as interpreted in accordance with applicable law. For example, according to the previously described preferred embodiments of the present invention, although the piston is used as an object for anodization, the invention may be applied to all metal products and components that have an outlet surface portion to be anodized. Also, although the middle portion of the piston in those axial directions is anodized by using the first and second seal members, a upper portion of the piston including the top ring groove and a piston head may be anodized by omitting the first seal member. Also, although the aluminum piston is anodized, the metallic components or parts made of magnesium, titanium, niobium, tantalum, zirconium, lead, and alloys of any of these may be anodized. Also, although the cathode plate is made of titanium, the cathode plate may be made of stainless steel or other appropriate metals. In this regard, U.S. Pat. No. 6,322,689 issued on Nov. 27, 2001 is incorporated by reference. Also, although the reaction medium contains sulfuric acid as the dissolved matter, chromic acid, boric acid, boric ammonium, phosphoric acid, oxalic acid, benzenesulfonic acid, sulfamic acid, citric acid, tartaric acid, formic acid, or succinic acid, or, the combination thereof may be contained as the dissolved matter.

This application relates to and incorporates herein by reference in its entirely Japanese Patent application No. 2001-339889, filed on Nov. 5, 2001, from which priority is claimed.

What is claimed is:

1. A method of anodizing a component comprising the steps of:

providing a container comprising a supply port, a drain port, and a supply passage connecting the supply port and the drain port, at least a portion of the supply passage including a reaction chamber in fluidly connection with a surface of the component to be anodized;

supplying an electric current from an electrode positioned between the drain port and the component surface; and supplying a reaction medium from the supply port to the drain port through the supply passage.

2. The method of claim 1, wherein said container further comprises at least one seal member separating a first surface of the component to be anodized from a second surface of the component not to be anodized.

3. The method of claim 2, wherein the supply passage comprises a supply portion adjacent the supply port, and a reaction flow passage portion including the reaction chamber, wherein the reaction flow passage portion is relatively significantly narrower than the supply portion.

4. The method of claim 3, wherein the reaction chamber has a boundary defined in part by the seal member.

5. The method of claim 4, further comprising providing at least two seal members that define in part the boundary of the reaction chamber.

6. The method of claim 3, further comprising providing a passage plate in the container, the passage plate extending at least partially into the reaction flow passage.

7. The method of claim 5, wherein the passage plate is an annular ring, wherein the component has a tube shape and the passage plate surrounds the component.

8. The method of claim 6, wherein the electrode is an annular ring provided on the passage plate.

9. The method of claim 8, wherein the passage plate has a recess, and the electrode is positioned in the recess.

10. The method of claim 6, wherein the passage plate has an outer ring portion and an inner ring portion, the outer ring portion having a thickness bigger than a thickness of the inner ring portion.

11. The method of claim 3, wherein the supply port is formed vertically below the reaction chamber, and the drain port is formed vertically above the reaction chamber.

12. The method of claim 2, further comprising providing at least one pushing pin that deforms said seal member.

13. (Currently Amended) A method of anodizing a component comprising the steps of:

providing a container comprising a supply port, a drain port, and a supply passage connecting the supply port and the drain port, at least a portion of the supply passage including a reaction chamber in fluidly connection with a surface of the component to be anodized;

supplying an electric current from an electrode positioned fluidly downstream of the component surface within the supply passage; and supplying a reaction medium from the supply port to the drain port through the supply passage.

14. The method of claim 13, wherein said container further comprises at least one seal member separating a first surface of the component to be anodized from a second surface of the component not to be anodized.

15. The method of claim 14, wherein the supply passage comprises a supply portion adjacent the supply port, and a reaction flow passage portion including the reaction chamber, wherein the reaction flow passage portion is relatively significantly narrower than the supply portion.

16. The method of claim 15, wherein the reaction chamber has a boundary defined in part by the seal member.

17. An apparatus for anodizing a component comprising:

a container comprising a portion defining a receiving hole for receiving the component into the container;

a supply port in the container for supplying a reaction medium;

a drain port in the container for draining the reaction medium;

a supply passage connecting the supply port and the drain port, at least a portion of the supply passage including a reaction chamber in fluidly connection with a surface of the component to be anodized;

an electrode for supplying an electric current, the electrode being positioned between the drain port and the component surface.

18. The apparatus of claim 17, further comprising a first seal member for separating a first surface of the component to be anodized from a second surface of the component not to be anodized.

19. The apparatus of claim 18, wherein the supply passage comprises a supply portion adjacent the supply port, and a reaction flow passage portion including the reaction chamber, wherein the reaction flow passage portion is relatively significantly narrower than the supply portion.

20. The apparatus of claim 19, wherein the reaction chamber has a boundary defined in part by the first seal member.

21. The apparatus of claim 19, wherein the supply port is formed vertically below the reaction chamber, and the drain port is formed vertically above the reaction chamber.

22. The apparatus of claim 19, further comprising a second seal member, wherein the first seal member and the second seal member separate an annular surface portion of the component to be anodized from a remaining surface portion of the component not to be anodized.

23. The apparatus of claim 22, wherein the reaction chamber has a boundary defined in part by the first seal member and the second seal member.

24. The apparatus of claim 19, further comprising a passage plate in the container, the passage plate extending at least partially into the reaction flow passage.

25. The apparatus of claim 17, wherein the supply passage has a ring shape, wherein the component has a tube shape and the supply passage surrounds the component.

26. The apparatus of claim 25, wherein the electrode is an annular ring, and the electrode surrounds the component.

27. The apparatus of claim 25, wherein the electrode has a tube shape, the electrode surrounds the component, and the electrode has a portion defining a hole that connects to the drain port.

28. The apparatus of claim 25, wherein the supply port and the drain port are formed on opposite sides of the container in a radial direction.

29. The apparatus of claim 25, further comprising a tubular wall which is positioned concentrically between an outer housing of the container and the reaction chamber, the tubular wall having a portion defining a hole that is fluidly upstream of the electrode for preventing backflow of the reaction medium from the drain port to the reaction chamber.

* * * * *